US006539188B2

(12) United States Patent
Matsumoto et al.

(10) Patent No.: US 6,539,188 B2
(45) Date of Patent: Mar. 25, 2003

(54) LIQUID DEVELOPING DEVICE, METHOD OF IT'S MAINTENANCE AND THE METHOD OF RECOVERY OF SUPPLEMENTAL FLUID FROM THE LIQUID DEVELOPING DEVICE

(75) Inventors: Shogo Matsumoto, Ushiku (JP); Kazutaka Satou, Kashiwa (JP); Mieko Ishii, Tsuchiura (JP); Yoshio Ohuchi, Toukai (JP); Junichi Matsuno, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/810,570

(22) Filed: Mar. 19, 2001

(65) Prior Publication Data

US 2002/0034399 A1 Mar. 21, 2002

(30) Foreign Application Priority Data

Sep. 19, 2000 (JP) ..... 2000-284058

(51) Int. Cl.[7] ..... G03G 15/08
(52) U.S. Cl. ..... 399/119; 399/111
(58) Field of Search ..... 399/119, 111, 399/112, 113, 120

(56) References Cited

U.S. PATENT DOCUMENTS 5,606,403 A * 2/1997 Kikuchi et al. ..... 399/27
6,193,426 B1 * 2/2001 Guillemin ..... 400/605
6,263,171 B1 * 7/2001 Oyamada ..... 399/57

FOREIGN PATENT DOCUMENTS

| | | |
|---|---|---|
| JP | 5-273862 | * 10/1993 |
| JP | 8-137285 | * 5/1996 |
| JP | 8-224885 | * 9/1996 |
| JP | 9-166474 | * 6/1997 |
| JP | 11-15280 | * 1/1999 |
| JP | 11-314375 | * 11/1999 |

* cited by examiner

*Primary Examiner*—Quana M. Grainger
(74) *Attorney, Agent, or Firm*—Antonelli, Terry, Stout & Kraus, LLP

(57) ABSTRACT

A liquid type development device for developing an electrostatic latent image formed on image-holding equipment by using liquid developer made of a highly insulating solvent and toner particles dispersed in the solvent has a liquid developer tank detachably situated in a cartridge; and at least one supplementary liquid tank containing supplementary liquid to be added to liquid developer contained in the liquid developer tank so as to keep the concentration of nonvolatile components in the liquid developer constant. Further, when the used development cartridge is recovered, and another new development cartridge is bought, a discount price privilege for the newly bought development cartridge is given to a user who has turned in the used cartridge.

20 Claims, 6 Drawing Sheets

RELATIONSHIP BETWEEN THE NUMBER OF PRINTED SHEETS AND CONCENTRATION OF NONVOLATILE COMPONENTS IN INK AFTER PRINTING (CALCULATION WAS PERFORMED ASSUMING THAT STORAGE CAPACITY OF INK CARTRIDGE IS 100cm$^3$)

LIQUID DEVELOPING DEVICE, METHOD OF IT'S MAINTENANCE AND THE METHOD OF RECOVERY OF SUPPLEMENTAL FLUID FROM THE LIQUID DEVELOPING DEVICE

BACKGROUND OF THE INVENTION

The present invention relates to a liquid type development device for developing an electrostatic latent image, which is formed by electronic photography, electrostatic recording, ionography, etc., using a liquid developer; and, the invention especially relates to features for improving th e ease of maintenance and the convenience of use of a development device using liquid type development in the formation of images.

Since toner having fine particles whose diameters are less than 1 $\mu$m can be used in a liquid type development device, a high-quality image, which is a faithful reproduction of its electrostatic latent image, can be obtained.

Liquid type development apparatuses using a liquid developer are disclosed, for example, in Japanese Patent Application Laid-Open Hei 11-15280 and Japanese Patent Application Laid-Open Hei 8-137285.

In the liquid type development device disclosed in Japanese Patent Application Laid-Open Hei 11-15280, a developer supply cartridge is filled with supplementary liquid developer along with high-pressure liquidized gas, and supplementary liquid developer is supplied to a developer-storing container for holding liquid developer by ejecting the supplementary liquid developer from the developer supply cartridge when the supply of liquid developer becomes necessary. This developer supply cartridge filled with supplementary liquid developer can be easily exchanged.

Further, the liquid type development device disclosed in Japanese Patent Application Laid-Open Hei 11-137285 includes a tube type container filled with a liquid developer having a high viscosity, in which a toner is intensively dispersed in an insulating liquid; a compressing device for extruding the liquid developer contained in the tube type container by squeezing out the liquid developer; and a development belt for holding and carrying the liquid developer extruded from the tube type container. Furthermore, the toner is fed to an electrostatic latent image on a photo conductor by bringing the development belt in contact with the photo conductor via the liquid developer. Moreover, since the liquid developer-storing means is implemented by use of a cartridge device, it is possible to supply or exchange the liquid developer without contaminating the user's hands.

In addition, techniques to improve the ease of maintenance for a liquid type development device by detecting and storing an indication of the amount of liquid developer remaining in a cartridge, are disclosed in Japanese Patent Application Hei 8-224885 and Japanese Patent Application Hei 11-314375.

In the techniques disclosed in Japanese Patent Application Hei 8-224885 and Japanese Patent Application Hei 11-314375, an ID number is allocated to each ink cartridge, and the amount of ink remaining in the cartridge is detected and the value thereof is stored. Accordingly, managing the amount of remaining ink is possible for each ink cartridge. Thus, even if an ink cartridge is exchanged with another one in mid-course, it is possible to entirely use up the ink remaining in the exchanged cartridge by attaching the cartridge again.

However, the above conventional techniques have the following problems. That is, since the conventional liquid type development device has no means for recovering liquid developer remaining in the liquid developer-storing device, it is desirable to entirely use up the liquid developer in the liquid developer-storing device once liquid developer is fed to the liquid developer-storing device from a developer supply cartridge; however, this leads to the problem that much unused developer remains if only a few copies are developed. In this regard, since the liquid developer-storing device is not sealed, the liquid developer will dry out, and dried developer will be deposited on the developer-holding device, which in turn deteriorates the quality of a developed image.

Further, in conventional liquid type development devices, since liquid developer is directly fed to a developer-holding device from a developer-storing means, the developer-storing means must be precisely controlled, which in turn deteriorates the tractability of the liquid development apparatuses. Furthermore, maintenance of the development apparatuses is difficult if the developer-holding device is composed of multistage rollers, since liquid developer applied onto the developer-holding device becomes dried and tends to form deposits, which in turn deteriorates the quality of a developed image.

In addition, in the disclosed conventional techniques, since no technique for promoting the recycling of remaining liquid developer and its container has been indicated, there is a fear that an increase in waste products will have an adverse effect on the environment.

SUMMARY OF THE INVENTION

An object of the present invention is to provide a liquid type development device which is capable of solving the above-described problems. Another object of the present invention is to provide a maintenance method for a liquid type development device, and to a method of efficiently recovering unused and remaining supplementary liquid, which is added so as to keep the concentration of liquid developer in the liquid type development device constant.

To achieve the above objects, the present invention provides a liquid type development device for developing an electrostatic latent image formed on an image-holding device by using a liquid developer made of a highly insulating solvent and toner particles dispersed in the solvent, the development apparatus comprising a liquid developer tank detachably situated in a cartridge; and at least one supplementary liquid tank containing supplementary liquid to be added to the liquid developer contained in the liquid developer tank so as to keep the concentration of nonvolatile components, which comprise the toner particles, in the liquid developer. Further, the cartridge in the development apparatus includes a memory device for storing information of the amount of supplementary liquid remaining in the supplementary liquid tank.

As described above, by setting the liquid developer tank and the supplementary liquid tank in the same cartridge, the number of parts which should receive maintenance can be reduced, and this improves the ease of maintenance of the development apparatus. Further, by providing a means for storing information as to the amount of remaining supplementary liquid in the cartridge, since the cartridge is recycled by the unit of a cartridge when it is recycled, maintenance-managing of the development apparatus will become easy, which in turn can improve the efficiency of recycling the supplementary liquid.

Furthermore, by calculating a discount price of a newly bought cartridge, corresponding to the amount of the remaining supplementary liquid, a user's tendency of casting away the remaining supplementary liquid can be suppressed, and a user's willingness to recycle the remaining supplementary liquid can be improved, which in turn can improve the efficiency of recovering the remaining supplementary liquid.

Also, by increasing the discount rate in phases corresponding to an increase of the remaining supplementary liquid, the user's tendency of casting away the remaining supplementary liquid can be suppressed.

Moreover, by changing the amount of supplementary liquid fed to the liquid developer, corresponding to the print ratio, since the concentration of nonvolatile components in the liquid developer can be approximately kept constant, the development can be stably continued.

Further, by preparing two kinds of supplementary liquid having different concentration levels of nonvolatile components, that is, concentration levels higher and lower than that of the liquid developer, since the concentration of nonvolatile components in the liquid developer can be approximately kept constant even if an image of any print ratio is developed, the development can be stably continued.

Furthermore, by providing an infiltration film at the boundary between the liquid developer and the supplementary liquid, since the concentration of the nonvolatile components in the liquid developer is kept constant by the action of the infiltration film, the concentration of the nonvolatile components in the liquid developer becomes more stable.

Moreover, in using a liquid type development device for developing an electrostatic latent image formed on an image-holding device by using liquid developer made of a highly insulating solvent and toner particles dispersed in the solvent, by giving a discount price privilege to a user who has turned in a used development device for recovery of the used development device, corresponding to the amount of supplementary liquid remaining in the development device, a user's tendency of casting away the remaining supplementary liquid can be suppressed. In addition, a user's willingness to recycle the remaining supplementary liquid can also be improved, and the efficiency of recovering supplementary liquid which remains yet can be improved.

On top of that, by using liquid of a developer including nonvolatile components of 1–30 wt % concentration, since the amount of liquid developer fed to the image-holding device can be reduced, it is possible to simplify the developer-feeding means. Also, since the amount of necessary liquid developer becomes small, the volume capacity of a liquid developer-storing means can be reduced, and this makes it possible to downsize the liquid type development device, which in turn makes it possible to decrease the size of the liquid type development device using the development device.

DETAILED DESCRIPTION OF THE EMBODIMENTS

Hereafter, details of the embodiments will be explained with reference to the drawings.

Figure 1:
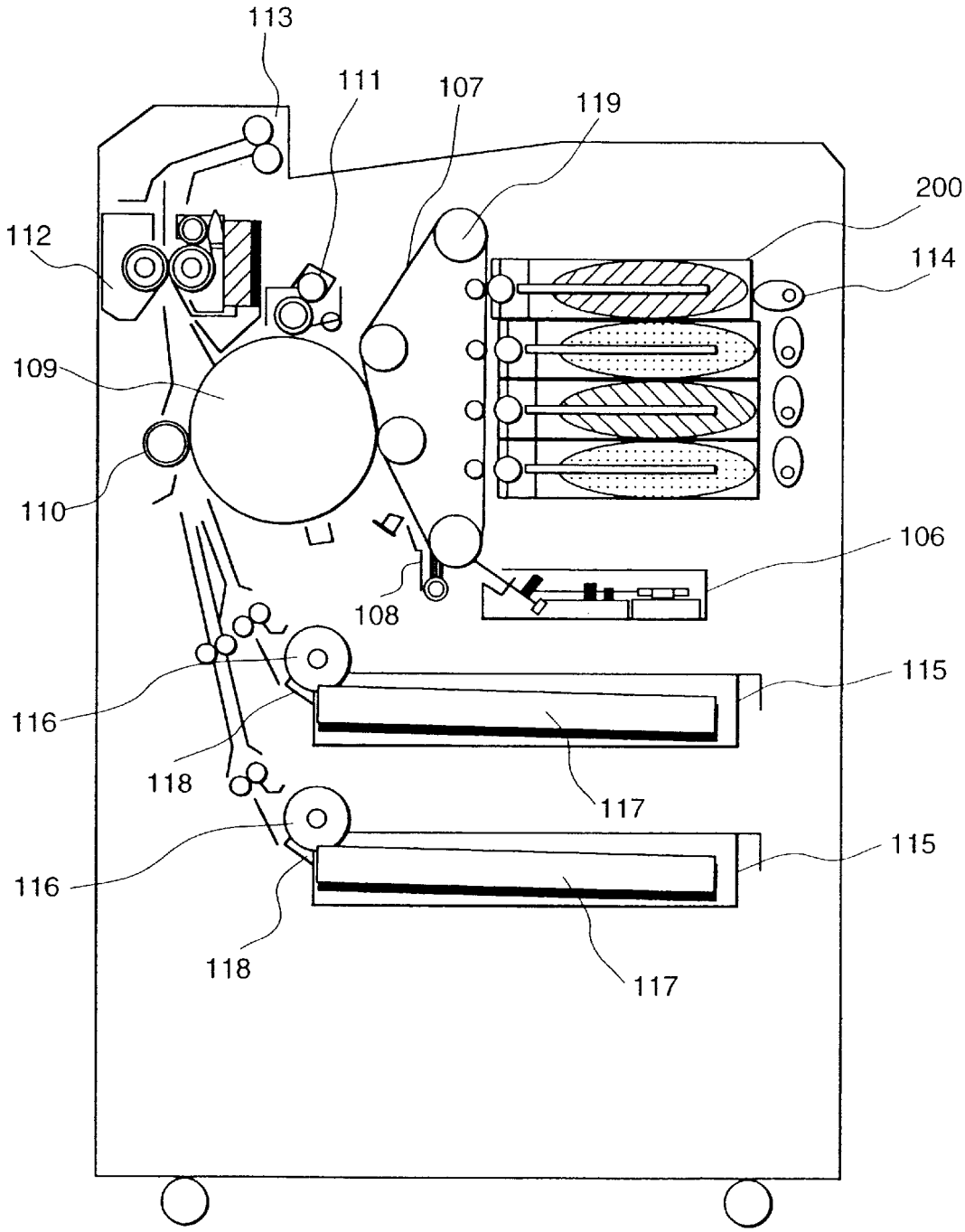
FIG. 1 is a schematic diagram showing the composition of an image printing apparatus using a liquid type development device representing an embodiment according to the present invention.

FIG. 1 schematically shows the composition of an image printing apparatus using a liquid type of development device representing an embodiment according to the present invention.

Paper sheets 117 are held in a paper sheet holder 115, and when an instruction to start printing is given, a sheet-feeding roller 116 takes out a paper sheet from the pager sheet holder 115 and transfers the sheet while it rotates clockwise as seen in this figure. Here, a double feed of sheets is prevented from being carried out by using a separation blade 118, this blade being situated at a middle point of the carrying route and being pressed to the sheet-feeding roller 116 with a predetermined quantity of pressing force.

A photo conductor belt 107 used as the image-holding device is wound around photo-conductor belt-moving rollers 119, and a predetermined quantity of tensile force is given to the belt 107. While the photo-conductor belt 107 is driven counterclockwise, its surface is uniformly charged, and a laser optical system 106 scans the surface of the belt 107 with a laser beam, corresponding to an image of each color, to form an electrostatic latent image on the surface of the belt.

In this embodiment, since the surface potential of the photo-conductive belt is controlled so that the polarity of the surface of the belt is equal to that of the toner particles, it becomes somewhat difficult for the toner particles to adhere to the belt, and this can effectively prevent fog phenomena from occurring in non-printed regions by application of liquid developer thereto, which is a problem in the case of developing a latent image by using liquid developer of high concentration.

The photo conductor belt 107 rotates further, and the latent image formed on the belt 107 is developed by toner from a development cartridge 200, which functions as a developing means. In this embodiment, development units for four colors including yellow, magenta, cyan, and black, are provided, and the above-described developing processes are performed for each of the four colors. Further, the developed toner images for the respective colors are transferred to and superimposed on a intermediate transfer drum 109. Then, after the superimposed toner image is transcribed from the surface of the intermediate transfer drum 109 onto the paper sheet 117 by a transfer roller 110, the transcribed toner image is fixed by a fixing device 112, and a full color image is obtained.

In this embodiment, there is a development unit cam 114 for moving a development cartridge 200 for each color in right and left directions, as seen in FIG. 1, via an elastic development unit supporter. Further, a development cartridge 200 corresponding to a color for which a latent image is to be formed and developed, is selected and operated by moving the development cartridge 200 in the direction toward the photo conductor belt 107 by rotating a cam corresponding to the selected color. In this operation of the development cartridge 200, the gap between a development roller and the photo conductor belt 107 is controlled by a gap-adjusting mechanism (not shown diagrammatically).

Further, a voltage, such as that which causes an electric field between the development roller 228 and the surface of the photo-conductive belt 107, for moving toner particles in the direction toward the development roller 228, is applied to the development roller 228. Consequently, it becomes somewhat difficult for the toner particles to adhere to the belt, and this can effectively prevent fog phenomena caused by liquid developer in non-printed regions, which becomes a problem in the case of developing a latent image by using liquid developer of high concentration.

Figure 2:
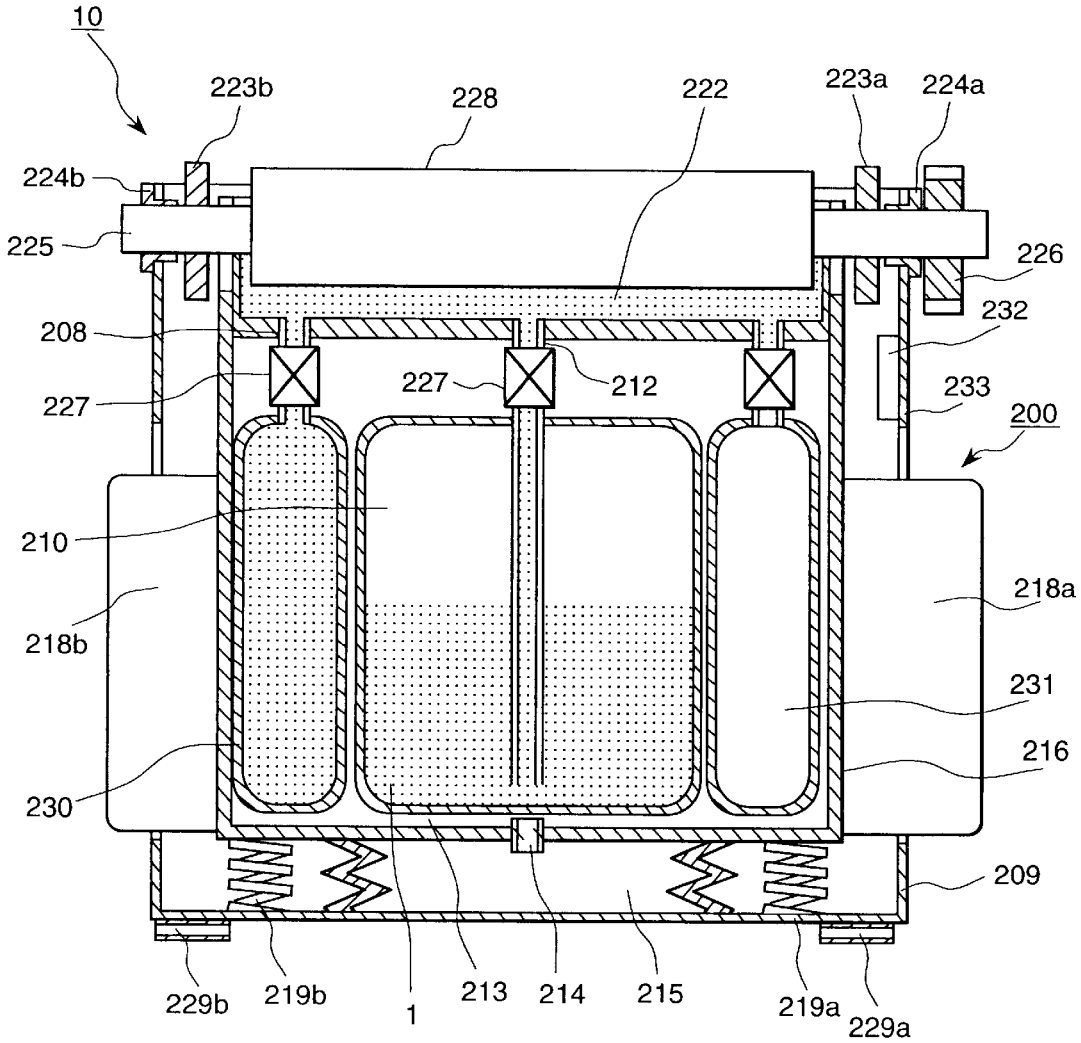
FIG. 2 is a top view of a development unit for an embodiment according to the present invention.

FIG. 2 shows a top view of the development unit for each color in an embodiment according to the present invention. This development unit 10 includes the detachable development cartridge 200, a liquid developer holder 222, and the development roller 228 immersed in the liquid developer held in the liquid developer holder 222. More specifically, the development roller 228 is not fully, but is only partially immersed in the liquid developer.

The development roller 228 is rotatably supported at its shaft 225 by bearings 224*a* and 224*b*, and the bearings 224*a* and 224*b* are fixed to a development unit cover 209. Also, gap-keeping rolling bearings 223*a* and 223*b* are arranged at both ends of the development roller 228. In this regard, while the photo-conductor belt 107 (not shown in this figure) contacts these rolling bearings 223*a* and 223*b*, the gap is maintained. Further, a gear 226 is attached to one end of the development roller 228, and the driving force of a development roller-driving motor (not shown diagrammatically) is transmitted to the development roller 228 via the gear 226.

A liquid developer tank 210, containing liquid developer 1, is held in a pressure chamber 213, which is sealed from the outside air, and this pressure chamber 213 is further held in an inner chassis 216. Further, the liquid developer holder 222 is fixed in the inner chassis 216, and the liquid developer holder 222 communicates with the liquid developer tank 210 via a liquid developer-feed/recover pipe 212. Also, a check-valve 227 is connected to the liquid developer-feed/recover pipe 212. Thus, the direction of liquid developer flow is restricted from the liquid developer tank 210 toward the liquid developer holder 222 in the feed operation, and vice versa in the recovery operation. Further, the pressure chamber 213 communicates with a pressure-generating chamber 215 via a pressure-transmitting pipe 214. The pressure-generating chamber 215 has a flexible structure such as that of a bellows type dropper, which is deformed by external force, and one end of the pressure-generating chamber 215 is fixed to the inner chassis 216. Also, the other end of the chamber 215 is fixed to a development unit cover 209 which is relatively movable with respect to the inner chassis 216 (in the upper and lower direction in FIG. 2). The pressure-generating chamber 215 is deformed by relatively moving the inner chassis 216 and the development unit cover 209 against the spring force of return springs 219*a* and 219*b*. The internal pressure of the pressure-generating chamber 215 changes with deformation of the chamber 215. Further, this pressure change is transmitted to the pressure chamber 213 via the pressure-transmitting pipe 214 and acts on the liquid developer tank 210. If the pressure-generating chamber 215 is compressed by the relative displacement between the inner chassis 216 and the development unit cover 209, the inside of the pressure chamber 213 is pressurized, and the liquid developer tank 210 is then compressed. Thus, the liquid developer 1 is fed to the liquid developer holder 222 via the liquid developer-feed/recover pipe 212. During this feed operation, a flow of the liquid developer and gas from the liquid developer holder 222 to the supplementary liquid tanks 230 and 231 via respective feed pipes 208 is prevented by check-valves 227.

In this embodiment, the inner chassis 216 is fixed to the body of the development apparatus (not shown in FIG. 2), and the development unit cover 209 moves in the upper direction as seen in FIG. 2 via elastic development-unit-supporters 229*a* and 229*b*, with the rotation of the development device cam 114 (not shown in FIG. 2), and this movement compresses the pressure-generating chamber 215. Further, in this embodiment, the bearings of the development roller 228 are fixed to the development unit cover 209. Accordingly, the development roller 228 moves in the upper direction as seen in FIG. 2 with the movement of the development unit cover 209, and is pressed to the photo conductor belt 107 (not shown in FIG. 2). Gap-keeping rolling bearings 223*a* and 223*b*, which have an outer diameter larger by a predetermined quantity than that of the development roller 228, are arranged at this roller 228 so as to maintain the gap between the photo conductor belt 107 (not shown in FIG. 2) and the roller 228.

In the operation of finishing the developing, by rotating the development cam (not shown in FIG. 2) attached to the body of the development apparatus from the position at which the developing operation has been performed, the development unit cover 209 is moved in the lower direction as seen in FIG. 2 by the spring force of the return springs 219*a* and 219*b*. When the development unit cover 209 is moved in the lower direction as seen in this figure, the development roller 228, whose bearings are fixed to the development unit cover 209, is also moved in the lower direction in this figure, and the development roller 228 is detached from the photo conductive belt (not shown in this figure). Thus, the developing operation is finished.

In this embodiment, the shape of the inner face of the liquid developer holder 222 is cylindrical, and its diameter is almost equal to that of the outer face of the development roller 228. Further, if the development roller 228 is moved in the lower direction as seen in FIG. 2 after the developing operation is finished, the development roller 228 closely contacts the inner face of the liquid developer holder 222, and this roller is held by the inner face of the holder 222.

In the embodiments of the present invention, since the liquid developer is not open to the air, it is possible to prevent the deterioration of the liquid developer due to evapotranspiration. Further, since the shape of the inner face of the liquid developer holder 222 is cylindrical and its diameter is almost equal to that of the outer face of the development roller 228, it is possible to provide a wide contact face between the liquid developer holder 222 and the development roller 228, which in turn can improve the sealing performance at the contact face.

On the other hand, when the development unit cover 209 is moved in the lower direction as seen in FIG. 2, the pressure-generating chamber 215 is expanded, and negative pressure is generated in the pressure chamber 213. Consequently, since the inside of the pressure chamber 213 is depressurized, and the liquid developer tank 210 is expanded due to the negative pressure, the liquid developer 1 in the liquid developer holder 222 is recovered into the liquid developer tank 210 via the liquid developer-feed/recover pipe 212. In this recovery operation, a flow of the liquid developer and gas from the liquid developer holder 222 to the supplementary liquid tanks 230 and 231 via the respective feed pipes 208 is prevented by the check-valves 227.

Here, in this embodiment, since a high concentration value of 1–30 wt % is set to nonvolatile components in the liquid developer, and the amount of liquid developer fed to the image-holding device can be reduced, it is possible to compose simple flow paths for the fed and recovered liquid developer. Moreover, by repeating the relative displacement between the inner chassis 216 and the development unit cover 209, the liquid developer 1 in the liquid developer holder 222 can also be mixed by stirring effects.

Meanwhile, in this embodiment, the liquid developer tank 210, and the supplementary liquid tanks 230 and 231, are contained in the cartridge along with the development devices, such as the development roller 228, and the cartridge is detachably held in the equipment. However, the composition of the cartridge according to the present invention is not restricted to the above compositions. For example, it is possible to provide equipment in which developing components, such as the development roller 228, are fixed to the equipment, and only the components of the liquid developer tank 210, and the supplementary liquid tanks 230 and 231 are contained in the cartridge which is held detachably in the equipment.

As mentioned above, in the embodiment, a liquid type development device is provided which performs developing operations by using liquid developer in which charged toner particles are dispersed, the device comprising a detachably situated cartridge; and a development roller which can be immersed in liquid developer in a liquid developer-holding device; wherein the cartridge includes a liquid developer tank connected to the liquid developer-holding device, and supplementary liquid tanks filled with supplementary liquid containing nonvolatile components dispersed in the liquid developer.

The above-mentioned supplementary liquid tanks can be composed of a high concentration supplementary-liquid tank filled with supplementary liquid containing nonvolatile components having a concentration higher than that of the nonvolatile components in the liquid developer, and a low concentration supplementary-liquid tank filled with supplementary liquid containing nonvolatile components having a concentration lower than that of the nonvolatile components in the liquid developer.

Also, as described previously, instead of providing a liquid developer tank and a supplementary liquid tank separately, it is possible to integrate a liquid developer tank and a supplementary liquid tank, and situate an infiltration film between a liquid developer section and a supplementary liquid section.

Moreover, an instrument for measuring the amount of supplementary liquid remaining in each supplementary liquid tank is provided, and a record device for storing information of the measured amount of remaining supplement liquid is also provided.

Figure 3:
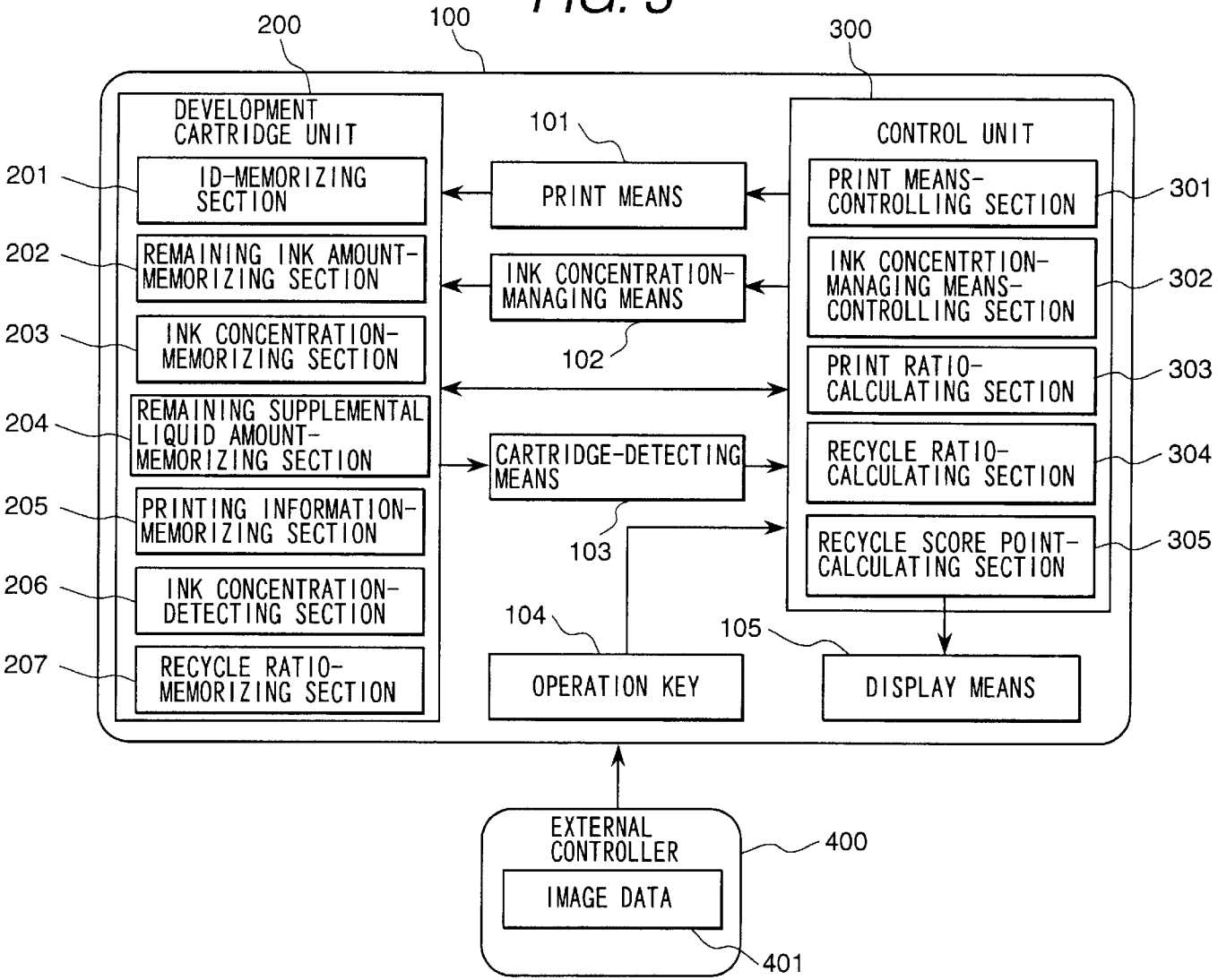
FIG. 3 is a schematic block diagram showing the circuit composition of record equipment for an embodiment according to the present invention.

FIG. 3 is a schematic block diagram showing the circuit composition of the record device in an embodiment according to the present invention. In this embodiment, the development cartridge 200 is detachably arranged with respect to the record device 100, and a control unit 300 is situated in the record device 100.

The development cartridge 200 includes data storing circuits formed of IC chips, used for an ID-memorizing section 201 for storing a serial number of each cartridge, a remaining ink amount-memorizing section 202 for storing data indicating the remaining amount of liquid developer, an ink concentration-memorizing section 203 for storing information as to the concentration of nonvolatile components in the liquid developer, a remaining supplementary liquid amount-memorizing section 204 for storing data of the remaining amount of supplementary liquid to be added to the liquid developer so as to keep the concentration of nonvolatile components in the liquid developer constant, a printing information-memorizing section 205 for storing printing conditions, such as the print ratio of the developed image, an ink concentration detecting section 226, and a recycle ratio-memorizing section 207 for storing the recycle ratio of liquid in the development cartridge, which is calculated based on the detected remaining amount of supplementary liquid.

If the image printing apparatus using the liquid type development device receives an instruction for printing an image from an external controller 400, such as a personal computer, a print means-controlling section 301 in a control unit 300 controls a print means 101, which is composed of a laser optical system, based on image data 401, a developing device, a fixing device, a paper sheet-carrying system, etc., and the sent image data 401 is printed as a visualized image. Also, a print ratio-calculating section 303 calculates the print ratio of the image based on the sent image data 401. Here, the print ratio is defined as the ratio of an area of a colored region to an area of a whole region in which the printing of each image is performed. An ink concentration-managing means-controlling section 302 calculates the amount of supplementary liquid to be added to liquid developer so as to keep the concentration of nonvolatile components in the liquid developer constant, based on the obtained print ratio, and controls an ink concentration-managing means 102 to supply the calculated amount of supplementary liquid to the liquid developer. In each developing operation, the remaining ink amount, the ink concentration, the remaining supplementary liquid, etc., are stored in a remaining ink amount-memorizing section in the development cartridge 200. Meanwhile, it is possible to improve the reliability of managing the concentration of ink, by comparing the ink concentration calculated by the control unit 300 with that detected by an ink concentration-detecting section 206, and to correct the ink concentration.

Further, in response to a calculation-requirement input from an operation key 104, a recycle ratio-calculating section 304 calculates the recycle ratio, and a recycle score point-calculating section 305 calculates the recycle score points based on the calculated recycle ratio. Then, a display means 105, such as a liquid crystal display, displays the calculated recycle score. Here, the recycle ratio is a value corresponding to the ratio of the remaining supplementary-liquid amount to the initial supplementary-liquid amount; and, if 30% of the initial amount is not used yet and is remaining in a supplementary liquid tank, the recycle ratio is fundamentally 30% . However, since the quality of liquid developer may deteriorate as time passes from time of production of the liquid developer, the ratio of remaining supplementary-liquid amount which can be recycled is calculated by considering various conditions, and this calculated recycle ratio is used and displayed. Also, the recycle score points correspond to the discount rate granted to the user of the cartridge when he replaces a new cartridge by purchase, and the recycle score points link to the recycle ratio. In order to prevent vexatious complication of treating the recycle score points, it is preferable to increase the recycle score point value in phases as an increase of the recycle ratio, while rounding a calculated value of the recycle score points.

According to this embodiment, by displaying the recycle ratio corresponding to the remaining amount of supplementary liquid, and by making the recycle ratio reflect the discount rate of the price, a user's tendency of casting away the remaining supplementary liquid can be suppressed, and a user's willingness to recycle the remaining supplementary liquid can also be improved.

Meanwhile, by determining a coefficient for calculation of the recycle ratio, which corresponds to the aging easiness of each supplementary liquid, and registering the determined coefficient in the ID-memorizing section 201, it becomes possible to control the feeding of the supplementary liquid while reflecting various improvements which had been implemented for supplementary liquid.

Moreover, the display means 105 displays the amount of supplementary liquid remaining in the supplementary liquid tanks 230 and 231 or the amount of liquid developer remaining in the liquid developer tank 210, automatically, or in response to a requirement signal input by a user. Also, it is possible to attract the attention of the user by generating an alarm or a flickering display on the display means 105 when at least one of the above respective remaining amount values decreases to less than a predetermined threshold value.

Figure 4:
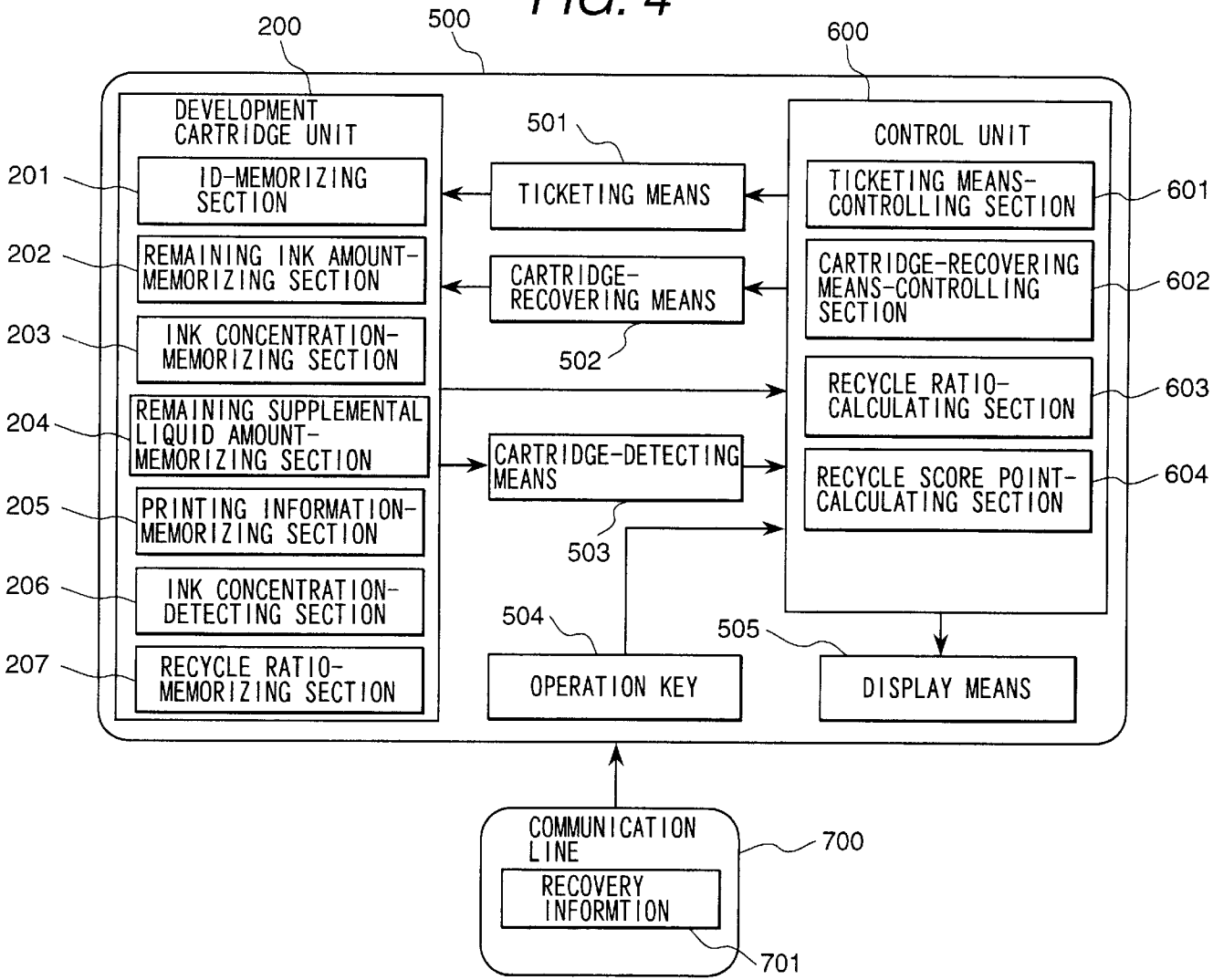
FIG. 4 is a schematic block diagram showing the circuit composition of a recovery means, which is used for recovering development cartridges, according to the present invention.

FIG. 4 is a schematic block diagram showing the circuit composition of a recovery box for recovering development cartridges, representing an embodiment according to the present invention.

When the development cartridge 200 is inserted into a cartridge-recovering box 500, the remaining state of supplementary liquid in the cartridge 200 is recognized by a cartridge state-detecting means 503, and various kinds of information stored in memory elements in the development cartridge are read out by a control unit 600. Further, a recycle ratio and recycle score points are calculated by a recycle ratio-calculating section 603 and a recycle score point-calculating section 604 based on the read-out information, respectively. A ticketing means 501, which is controlled by a ticketing means-controlling section 601, issues a recycle ticket indicating the recycle score points. In place of issuing a recycle ticket, it is possible to write the recycle score points in a magnetic card.

The development cartridge 200 inserted into the development cartridge-recovering box 500 is recovered and stored in the development cartridge-recovering box 500 by a cartridge-recovering means 502 controlled by a cartridge-recovering means-controlling section 602. The information read out of the recovered cartridge 200 is transmitted to the maker which fabricated the cartridge 200 or to a recycle company via a communication line 700. Thus, the used and stored cartridge 200 is occasionally recovered, and is recycled.

Figure 5:
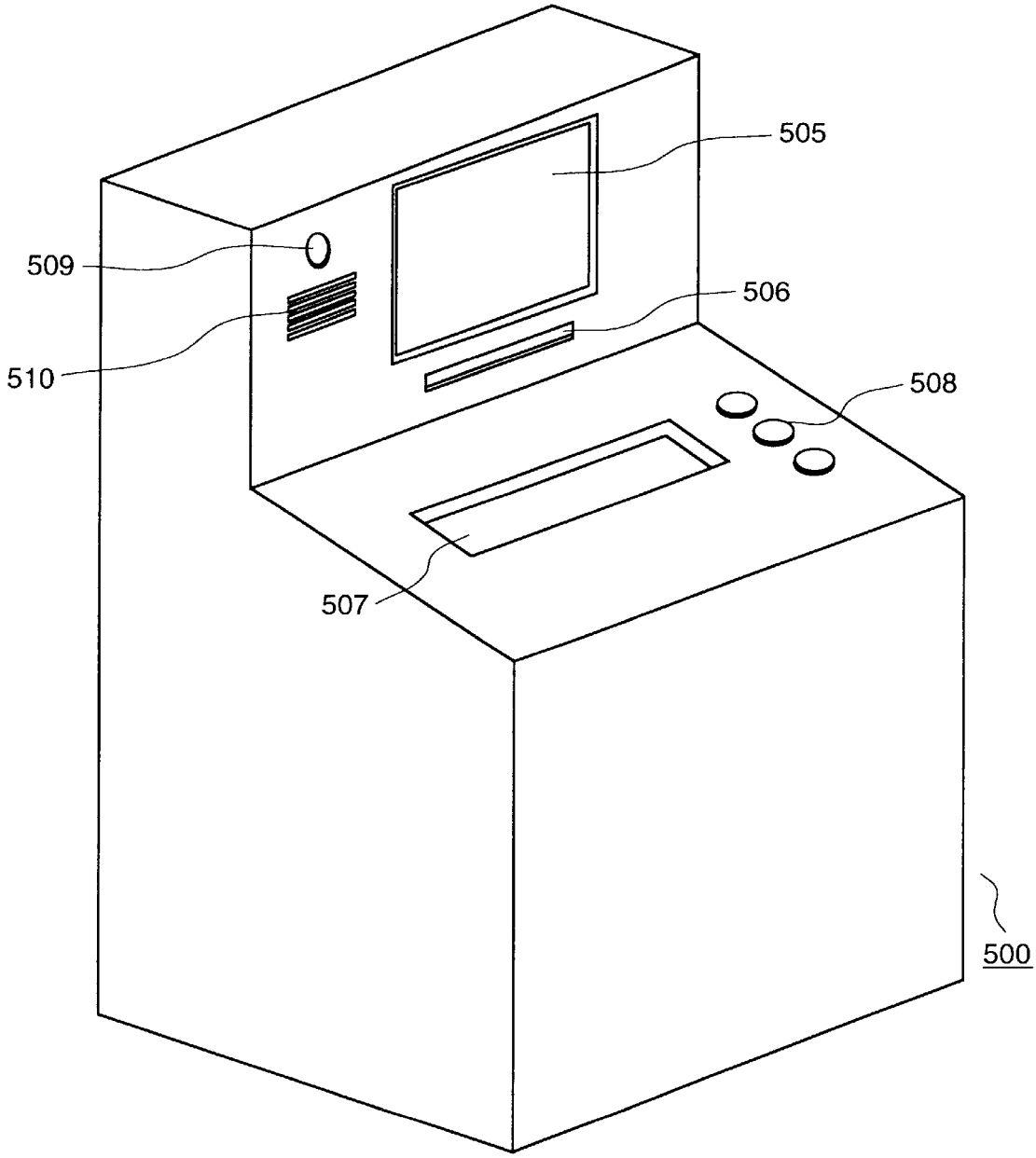
FIG. 5 is a perspective view of a recovery box implementing the recovery means according to the present invention.

FIG. 5 shows an example of the development cartridge-recovery box 500 implementing the recovery means of the present invention.

A development cartridge-recovering inlet 507 is provided at the development cartridge-recovery box 500, and the development cartridge 200 is inserted into this inlet 507. Operation guidance, a result of calculation, etc., are displayed on a display means 505, such as a liquid crystal display device, and an operator operates an operation panel 508. Also, voice guidance from a speaker 519 is jointly used. Further, the behavior of the operator is detected by a monitor camera 509, and the intention of the operator is determined by using the detected information along with operations entered through the operation panel 508.

Although the development cartridge-recovery box 500 is provided in this embodiment, if the external controller 400 connected to the record device 100 is further connected to a communication line, it is possible to transmit the calculation results obtained in the control unit 300 from the external controller 400 along with information for identifying the cartridge or the supplementary liquid tanks to a development cartridge-recovery shop via the communication line. In this case, the used development cartridges can be recovered by another method, such as hand delivery mailing, shipping, etc.

Figure 6:
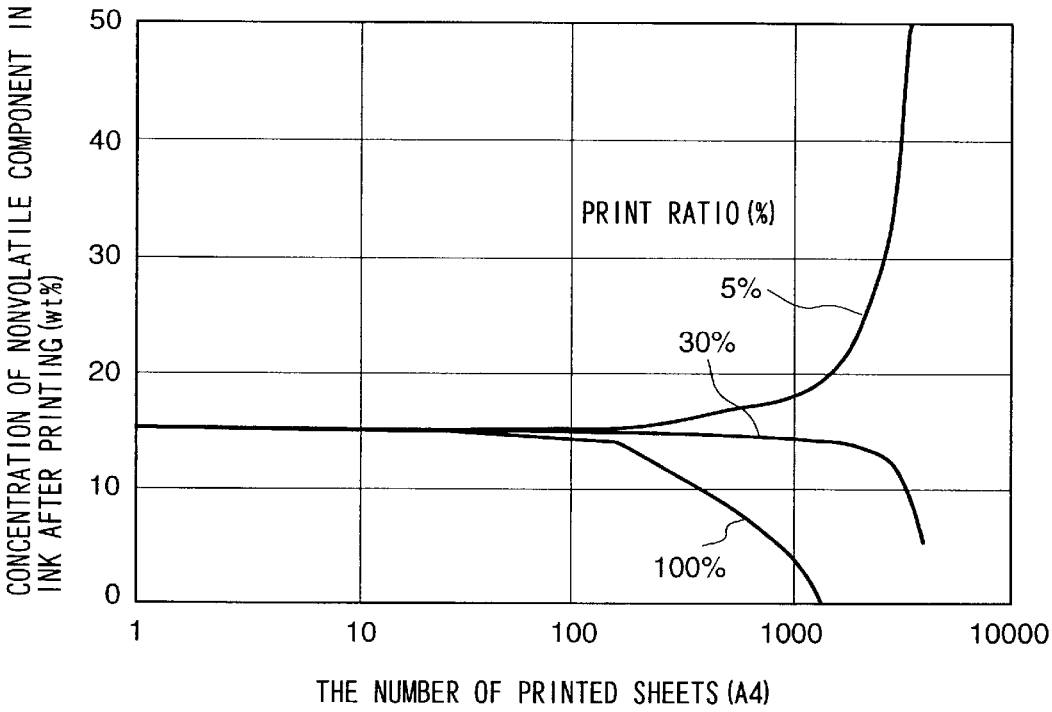
FIG. 6 is a graph showing the relationship between the number of printed sheets and the concentration of nonvolatile components in ink after printing.

Next, a method of adjusting the concentration of nonvolatile components in liquid developer will be explained. In the liquid type development device of the present invention, in order to use liquid developer efficiently without waste, liquid developer used development operations are recovered and reused. In such a system, the performance of many time-development operations will produce changes in the concentration of nonvolatile components in the liquid developer depending on the print ratios of developed images, as shown in FIG. 6. This is because toner particles are consumed in a colored region, and solvent is consumed in a non-colored region. Accordingly, if many images having large print ratios, which have large colored regions, are continuously developed, the concentration of nonvolatile components decreases. Conversely, if many images having small print ratios, which have small colored regions, are continuously developed, the concentration of nonvolatile components increases. FIG. 6 shows results of calculated changes in the concentration of nonvolatile components assuming that the print ratio is constant, and it is confirmed that the results well agree with results of changes in the concentration of nonvolatile components obtained in printing experiments. Thus, since the concentration of nonvolatile components after printing can be estimated from the print ratio obtained by using the image data of a printed image, the amount of supplementary liquid to be fed can be obtained so as to correct changes in the concentration of nonvolatile components.

In the embodiment shown in FIG. 2, there are two types of supplementary tanks, that is: a high concentration supplementary liquid tank 230 containing supplementary liquid in which the concentration of nonvolatile components is higher than that in the liquid developer, and a low concentration supplementary liquid tank 231 containing supplementary liquid in which the concentration of nonvolatile components is lower than that in the liquid developer. In this way, by preparing two kinds of supplementary liquid, it is possible to keep the concentration of nonvolatile components almost constant by adding supplementary liquid contained in the high concentration supplementary liquid tank 230 to the liquid developer 1 when images having high print ratios are continuously printed, and adding supplementary liquid contained in the low concentration supplementary liquid tank 231 to the liquid developer 1 when images having low print ratios are continuously printed, which in turn can keep the development state stable.

The information, such as the remaining amount of supplementary liquid, which is obtained by the control unit 600, is stored in a memorizing device 232 via a terminal 233 for the memorizing device 232.

As mentioned above, the present invention provides a maintenance method of performing maintenance work on a liquid type development device for developing an electrostatic latent image formed on an image-holding device by using liquid developer in which charged toner particles are dispersed, wherein the remaining amount of supplementary liquid used to keep the concentration of nonvolatile components in the liquid developer constant, which is contained in each supplementary liquid tank, is measured and the value thereof is stored; and the stored value of the remaining amount of supplementary liquid is displayed when the cartridge containing the supplementary liquid tank is exchanged.

Moreover, when a new cartridge is bought, a discount rate of the price of the new cartridge is calculated corresponding to the above-mentioned remaining amount of supplementary liquid, and the discount rate of the price is indicated.

Further, the present invention provides a supplementary liquid-recovery method of recovering supplementary liquid from a liquid type development device for developing an electrostatic latent image formed on an image-holding device by using liquid developer in which charged toner particles are dispersed, including detachable cartridges, in each of which a development roller is immersed in liquid developer held in a liquid developer-holding component, each cartridge containing a liquid developer tank connected to the liquid developer-holding component and at least one supplementary liquid tank filled with supplementary liquid including nonvolatile components which comprise the toner particles in the liquid developer; wherein the supplementary liquid tank is detachably set in the cartridge, and supplementary liquid remaining in the supplementary liquid tank is recovered by detaching the supplementary liquid tank from the cartridge.

In this supplementary liquid-recovery method also, when a new cartridge is bought, a discount rate of the price for the new cartridge is calculated corresponding to the above-mentioned remaining amount of supplementary liquid, and the discount rate of the price is indicated.

Also, when a used development device, including the cartridge, the development roller, and the developer-holding component, is recovered, and a new development device is bought, a discount rate of the price for the new development device is calculated corresponding to the remaining amount of supplementary liquid.

Additionally, it is possible to recover high and low concentration liquid separately, from a high concentration supplementary liquid tank 230 containing supplementary liquid in which the concentration of nonvolatile components is higher than that in the liquid developer, and from a low concentration supplementary liquid tank 230 containing supplementary liquid in which the concentration of nonvolatile components is lower than that in the liquid developer.

In accordance with the present invention, it has become possible to provide a liquid type development device which is easily maintained, and from which remaining liquid developer and supplementary liquid are easily recovered. Further, the maintenance of a liquid type development device and the recovery of liquid developer and supplementary liquid have also become easier by using liquid developer of high concentration, whose evapotranspiration to the air is small, and for which a recirculation component for controlling its concentration is not necessary. The operation is improved by providing a cartridge including the liquid developer and supplementary liquid to be added to the liquid developer, so as to keep the concentration of the liquid developer constant, and storing information as to the amount of supplementary liquid remaining in the cartridge. Furthermore, by giving a user a special privilege of a discount price for a new development cartridge corresponding to the amount of supplementary liquid remaining in a used development cartridge, the convenience in dealing with a development cartridge can be improved, and a user's tendency of casting away the remaining supplementary liquid can be suppressed. In addition, a user's willingness to recycle the remaining supplementary liquid can be improved, and the efficiency of recovering the remaining supplementary liquid can be improved.

What is claimed is:

1. A liquid type development device for developing an electrostatic latent image formed on image-holding equipment by using liquid developer in which charged toner particles are dispersed, said device comprising:

a detachable cartridge; and a development roller which is immersed in said liquid developer held in a liquid developer-holding unit situated in said detachable cartridge;

wherein said cartridge further contains a liquid developer tank connected to said liquid developer-holding unit, and at least one supplementary liquid tank filled with supplementary liquid including the toner particles which are nonvolatile components in said liquid developer.

2. A liquid type development device according to claim 1, wherein said cartridge contains a high concentration supplementary liquid tank containing supplementary liquid which includes nonvolatile components of higher concentration than that of nonvolatile components in said liquid developer, and a low concentration supplementary liquid tank containing supplementary liquid which includes nonvolatile components having a concentration which is lower than that of nonvolatile components in said liquid developer.

3. A liquid type development device according to claim 2, further including liquid developer concentration-control means for controlling the amount of supplementary liquid fed to the liquid developer in said liquid developer-holding unit from said respective supplementary liquid tanks so as to keep the concentration of nonvolatile components in the liquid developer of said liquid developer-holding unit at a predetermined constant level.

4. A liquid type development device according to claim 1, further including print ratio-estimation means for estimating a print ratio of an image to be developed, wherein said liquid developer concentration-control means controls the amount of the supplementary liquid to be fed to the liquid developer based on said print ratio of said image, which has been estimated by said print ratio-estimation means.

5. A liquid type development device according to claim 1, wherein said liquid developer tank and said supplementary liquid tank is integrated into one tank, and liquid developer and supplementary liquid are partitioned at a boundary between said liquid developer and said supplementary liquid by means of an infiltration film.

6. A liquid type development device according to claim 1 wherein said development roller held in said liquid developer-holding unit situated in said detachable cartridge is detachable therewith.

7. A liquid type development device according to claim 1 wherein a shape of an inner face of said liquid developer holder substantially corresponds to a shape of an outer face of said development roller.

8. A liquid type development device for developing an electrostatic latent image formed on image-holding equipment by using liquid developer in which charged toner particles are dispersed, said device comprising:

a detachable cartridge; and a development roller which is immersed in said liquid developer held in a liquid developer-holding unit situated in said detachable cartridge;

wherein said cartridge further contains a liquid developer tank connected to said liquid developer-holding unit, and at least one supplementary liquid tank filled with supplementary liquid including the toner particles which are nonvolatile components in said liquid developer;

wherein an instrument for measuring the amount of said supplementary liquid remaining in said respective supplementary liquid tanks is provided at said supplementary liquid tanks; and wherein record equipment for storing the measured amount and printing condition of said remaining supplementary liquid is provided.

9. A liquid type development device according to claim 8, wherein a shape of an inner face of said liquid developer holder substantially corresponds to a shape of an outer face of said development roller.

10. A maintenance method of maintaining a liquid type development device for developing an electrostatic latent image formed on image-holding equipment by using liquid developer in which charged toner particles are dispersed, said method comprising the steps of:

measuring the amount of supplementary liquid remaining in a supplementary liquid tank filled with said supplementary liquid to be added to said liquid developer so as to keep the concentration of nonvolatile components, which are the toner particles, in said liquid developer at a predetermined value;

storing a value corresponding to the measured amount of said supplementary liquid which remains in said supplementary liquid tank; and indicating said amount of said supplementary liquid which remains in said supplementary liquid tank using said stored value when a cartridge containing said supplementary liquid tank is exchanged.

11. A maintenance method according to claim 10, wherein, when a new cartridge is bought, a discount price for said new cartridge is calculated corresponding to said amount of said supplementary liquid which remains in said supplementary liquid tank contained in said exchanged cartridge.

12. A liquid type development device according to claim 10 wherein an inner face of said liquid developer holder is provided with a shape substantially corresponding to a shape of an outer face of said development roller.

13. A supplementary liquid recovery method of recovering supplementary liquid from a liquid type development device for developing an electrostatic latent image formed on image-holding equipment by using liquid developer in which charged toner particles are dispersed, said liquid type development device including a detachable cartridge, a development roller immersed in liquid developer held in a liquid developer-holding unit situated in said cartridge in which a liquid developer tank and at least one supplementary liquid tank filled with supplementary liquid of nonvolatile components which are toner particles;

wherein said supplementary liquid tank is operated so as to be in a state capable of being detached from said cartridge, and the supplementary liquid remaining in said supplementary liquid tank is recovered by detaching said supplementary liquid tank from said cartridge.

14. A supplementary liquid recovery method according to claim 13, wherein, when a new cartridge is bought, a discount price for said new cartridge is calculated corresponding to said amount of said supplementary liquid remaining in said supplementary liquid tank contained in said exchanged cartridge.

15. A supplementary liquid recovery method according to claim 13, wherein, when used development equipment including said cartridge, said development roller, and said liquid developer-holding unit is recovered, and another new development equipment is bought, a discount price for said new development equipment is calculated corresponding to said amount of said supplementary liquid remaining in said supplementary liquid tank contained in said exchanged cartridge.

16. A supplementary liquid recovery method according to claim 13, wherein an instrument for measuring the amount of said supplementary liquid remaining in said supplementary liquid tank is provided at said supplementary liquid tank, and record equipment for memorizing the measured amount and printing condition of said remaining supplementary liquid is provided.

17. A supplementary liquid recovery method according to claim 16, wherein said stored value of the amount of said remaining supplementary liquid is transmitted to a supplementary liquid-recovering shop along with information for identifying said supplementary liquid tank in which said remaining supplementary liquid is to be recovered, from an external controller connected to said liquid type development device via a transmission line connected to said external controller.

18. A supplementary liquid recovery method according to claim 13, wherein said cartridge contains a high concentration supplementary liquid tank containing supplementary liquid which includes nonvolatile components of higher concentration than that of nonvolatile components in said liquid developer, and a low concentration supplementary liquid tank containing supplementary liquid which includes nonvolatile components of lower concentration than that of nonvolatile components in said liquid developer.

19. A supplementary liquid recovery method according to claim 13, wherein said development roller held in said liquid developer-holder unit situated in said detachable cartridge forms a part of said detachable cartridge and is detachable therewith.

20. A supplementary liquid recovery method according to claim 13, wherein a shape of an inner face of said liquid developer holder substantially corresponds to a shape of an outer face of said development roller.

* * * * *